United States Patent [19]

Perry

[11] 3,991,901

[45] Nov. 16, 1976

[54] CONTAINER OPENING SEGMENT WITH ATTACHMENT

[76] Inventor: Walter Merton Perry, 76 Locust Hill Road, Darien, Conn. 06820

[22] Filed: Sept. 26, 1975

[21] Appl. No.: 617,002

Related U.S. Application Data

[63] Continuation-in-part of Ser. No. 354,807, April 26, 1973, Pat. No. 3,908,856.

[52] U.S. Cl. ..... 220/269; 220/90.6; 220/273

[51] Int. Cl.[2] ..... B65D 41/32

[58] Field of Search ..... 220/265–269, 220/270–273, 90.6

[56] References Cited

UNITED STATES PATENTS

| | | | |
|---|---|---|---|
| 3,411,661 | 11/1968 | Perry | 220/273 |
| 3,442,416 | 5/1969 | Nicholson | 220/269 |
| 3,743,129 | 7/1973 | Willis et al. | 220/269 |
| 3,795,342 | 3/1974 | Ashton | 220/269 |

*Primary Examiner*—George T. Hall

[57] ABSTRACT

Relates to easy opening container tops in which there is a tear strip which remains attached to the container after opening. The tear strip has an elongated U-shape, with a ring tab attached at the end of the loop which is near the outer border of the container top. The inner end of the tear strip has an unscored section which serves to hold the strip attached to the top after opening. Stiffening, such as ribbing, is provided in the tear strip to keep it fairly flat during and after opening, and to provide protection against the sharp edges. A cavity is provided in the top into which the strip partially folds to be out of the user's way. Small ribe alongside the rivet that attaches the pull ring, and in the unscored attachment section, serve to prevent the material of the top at these points from bending too sharply, and possibly breaking off. The inner end of the opening may curve to one side so the strip in the opened position will clear the user's nose when drinking from the container.

14 Claims, 30 Drawing Figures

CONTAINER OPENING SEGMENT WITH ATTACHMENT

This invention relates to easy open containers having a partially removable tear out of segment, and such that the pull tab and the closure segment remain attached to the container after opening. This application is a continuation-in-part of my application Ser. No. 354,807, which was filed on Apr. 26, 1973, now U.S. Pat. No. 3,908,856.

BACKGROUND OF THE INVENTION

1. Field of the Invention

This invention relates to containers, especially metal cans, and more particularly to such containers that have a self contained means for opening by hand without requiring separate mechanical opening device. The containers may be used for almost any product, but they are most commonly used for liquids, and especially for carbonated beverages where they may be subjected to high internal pressures of 100 pounds per square inch or more. The contents may be poured out, or the user can drink directly from the can.

The invention applies to the types of containers which are commonly called easy-opening or self-opening containers. It applies particularly to the various types which have an opening area or segment which is defined by a score line in the top, and to one end of which a lifting tab is attached for first rupturing the score line at the tab end, and then for tearing the segment open by progressive rupturing along the score lines defining the borders of the segment. The segment is usually elongated and often wedge shaped, and usually extends from the rim to near the center of the top where the opening serves to admit air as the contents are discharged.

The opening device is generally located in the top of the can, and for this reason the top is usually made of aluminum because it may be made thicker than steel, and is much easier to score accurately. Aluminum is softer for easier rupturing along the score lines. Also the lifting tab, which is generally in the shape of a ring, is often attached to the segment end by an integral rivet drawn from the metal of the segment, providing an inexpensive and leakproof attachment. Prior art teaches several ways to construct the tab in such a way that a light pull on the tab will through leverage means exert a very high lifting force on the rivet, as required to initiate rupture in the small arc of score line adjacent the rivet. Some ring tabs initiate rupture further away from the rivet, but they must be larger and more expensive. A steel container top is also in use. It has an aluminum frame adhesively mounted in the top, and is fitted with an aluminum panel having a score defined removably segment. The tab is an extension of the metal of the panel, and a soft foamed plastisol seals around the tab base for easy rupture.

Beverage containers made with tear out segments are often opened outdoors, and because of their great popularity, the discarded tab and sharp edged segments have become a nuisance on the ground from appearance and safety standpoints, and when thrown in the ocean they endanger fish. Easy opening containers that have opening segments that do not remain attached to the can are being legislated against in some states.

My invention primarily concerns the field of use where the opening segment remains attached to the container, but some of the improvements of the invention apply also to tear out segments that are discarded separately, and of coarse at present this is by far the largest field.

2. Description of Prior Art

The type of easy opening top with a wedge shaped opening segment defined by a score line, and with a ring shaped lifting tab attached to one end has been very successful due to its low cost, ease of manufacture, freedom from leakage, resistance to damage during shipment, and ease of opening. The most common type has the ring attached by the integral rivet to the segment at the center of a round can, and arranged to tear toward the rim. Some have the ring attached near the rim and tear toward the center, but here the ring must be made stronger and is more expensive, and the pulling force to initiate rupture of the score at the rivet is generally greater.

Tests made on current production of the most common makes of openers with tear out segments and with the pull tab located at the center of the can top gave the following results. The initial pull to raise the tab ring and start the end score break is 2 to 4 pounds. The progressive pull required to tear the remainder of the side score lines up to the far end is 4 to 7 pounds. When the end score is reached the segment stands vertically, and the straight pull to break off the narrow width of score across the end varies from 8 to 12 pounds. The user often has to rock the segment back and forth to make the end rupture more easily than with a straight pull. This condition is taken care of by features of my invention.

There have been a number of methods proposed for attaching the opening segment to the container after it is torn out. One type of proposed tear strip opener has the tear strip in the form of a U with the pull tab attached at the closed end and located near the rim of the top. The score line extends across the end around the integral rivet holding the tab, and then down each side toward the interior to the far end of the segment where the metal remains unscored between the two side scores to serve as an attachment to the top after opening. U.S. patents based on this principle include Smith 3,327,891, Arfert 3,404,800, Luviano 3,441,168, Nicholson, 3,442,416, and Stolle 3,462,042.

When such a tear strip is torn along its length, the pull is upward or forward, and this imparts a continuous curvature to the metal of the tear strip. The strip can not be drawn out flat as the metal is resilient and will spring back, so the tear strip in this case will have an upward curvature, and it will also spring substantially away from the rim of the can on the far side. It can only be flattened down by hand, with the user may not do. As a result the sharp edged strip projects out to interfere with the drinker's nose, possibly causing cuts. Another disadvantage is that the metal takes a very sharp bend at the inner end where the score lines terminate, and this bend is almost 180°. If the segment is bent back after use to its former position it will generally break off. The user may often do this, and if the resulting detached strip is thrown on the ground it will be sharper and more of a nuisance than the regular unattached segment.

U.S. Pat. No. Chun 3,420,398 provides an elongated wire or plastic strip positioned inside the can and connecting the under side of the top with the under side of a standard type of tear out segment like a tether. It is felt that having the attachment in the drink may be a disadvantage, and also the segment and ring tab at the end of the connector has an uncontrolled position after bending back, and may fall on the user's face. The considerable length adds to the cost if a plastic strip is used. A wire would have to be steel to hold on rivets, and this requires rust prevention at considerable cost.

It is thus seen that there remains a need for an improved method of attachment for the opening segment which will be low in cost, not interfere with drinking from the can, and not subject the user to possible injury.

BRIEF SUMMARY OF THE INVENTION

It is a primary objective of the invention to provide an easy opening means for a container in which the opening segment remains attached to the container so it can not be discarded separately.

It is a primary objective of the invention to swivel the segment assembly to one side and tightly held against the top where it is safely away from the user's face if he chooses to drink from the can, and with no sharp edges protruding to cause cuts.

Another primary objective of the invention is to provide such attachable means which is applicable to the present most widely used and successful self opening arrangement which comprises a score defined segment in the top with a lifting tab at one end, and generally in the form of a ring, and which is used for tearing the segment out along the score lines of the aluminum top.

Another objective of the invention is to provide a swivel attachment means that is very strong, low in cost, and that can be produced with very little change in the production equipment which is now available for very high volume output.

Another objective of the invention is to provide swivel means so the segment can be swung to one side for pouring liquids.

Another objective of the invention is to provide a short swivel arm attached to the segment and to the top, and one that can be flexed or bent to permit tearing the segment free, but which will then spring back to its flat shape to hold the segment snug against the top.

Another objective of the invention is to use one of the very many materials which are suitable for the swivel arm and which can be easily cut to the desired shape, and which include polyamides, polypropylene, polyvinyl chloride, and the like.

Still another objective is to provide a swivel linkage which will assist in breaking the score line at the far end where the present tear out segments require the greatest pull.

A further objective of the invention is to provide ribbing in the segment extending in a generally lengthwise direction, and which serves both to maintain the flatness of the segment during tearing out, and also to reduce the amount of pull required.

Still another objective of the invention is to extend ribbing beyond the end score at the far end to assist in rupture of the final piece of score line that is now hard to break off.

Another objective of the invention is to provide a number of ribs that are press formed in the metal of the segment, that extend in a generally lengthwise direction, that are offset in line, and that the ends of which overlap in the lengthwise direction in order to provide the desired degree of the stiffness without buckling, and applicable to both attached and unattached segments.

Another objective of the invention is to provide a strong compact swivel arm for swiveling the opened segment over to one side to clear the opening, and that is applicable to the type of tear out segment in which the tab is located near the top rim to tear toward the center as well as the type having the tab in the center and tearing toward the rim.

Another objective of the invention is to position the swivel arm so it assists in rupture of the end score when used on the type opener which has the tab ring located near the can rim.

Still another objective of the invention is to apply almost all of these improvements to the steel top container design in which a frame carrying an aluminum panel with opening segment is adhesively secured in the steel top.

Another objective of the invention is to attach the swivel arm to the segment and to the can top by rivets, preferably of the integral type drawn from the top material. Another objective of the invention is to use adhesive to optionally replace a rivet.

Another objective of the invention is to provide friction plus a protruding boss to hold the swiveled assembly in the side position.

Another objective of the invention is to provide a short additional score line on the under side of the top directly below the upper score to make opening easier, and to protect the metal with lacquer or foamed plastisol.

Another objective of the invention is to provide a small rib in the metal of the segment near the rivet holding the tab and extending back alongside the rivet to force a larger radius of curvature in the metal when it is doubled back as with the type opener that has the tab near the can rim, and to prevent breaking off at a point just in front of the rivet.

Another objective of the invention is to press form a rib in the end of the segment that is away from the tab, and to extend this rib across the end score line to assist in rupture of the score line that is across this end.

Another objective of the invention is to improve the type of opener with attached segment in which the lifting tab is near the rim, the score is shaped like a U with the two score lines along the sides and extending to the top interior where they terminate, and leaving the metal in the space between their inner ends unscored and serving as an attachment to the can top after opening. These invention improvements include the ribbing for reducing breakage at the rivet and for decreasing the amount of curvature formed in the segmental strip as it is torn out.

Another objective of the invention with this type opener is to provide a small rib between the inner ends of the score lines to force a larger radius of curvature at the inner end, and to permit beinding the strip back without it breaking off.

Another objective of the invention to obtain the same effect is to form the metal between the ends of the scores in a curve so it will take its own less sharp bend at this end. Still another objective of the invention for this type opener is to curve the score lines so that segments folds down off to one side, and to provide a cavity in the can top into which the tear strip folds.

Another object of the invention with this type of opener is to apply the improvements, other than the side curve, to the tear strip that extends straight across the top of the container.

Still another objective of the invention for the type of opening segment where the lifting tab is located near the can rim is to raise the immediate area of the top at the segment and nearby to the level of the center of the crowned center so when the score line is first ruptured near the rim gases escape rather than blowing out liquid. This applies to carbonated products.

Other objectives and advantages of the invention will become apparent from a study of the specification and the drawings.

FIG.. 25 is a plan view of a container top showing a tear out segment that opens straight across and with an unscored section at the inner end for attachment, and a cavity for storage.

Figure 26:
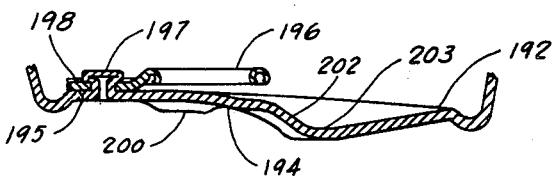
Figure 25:
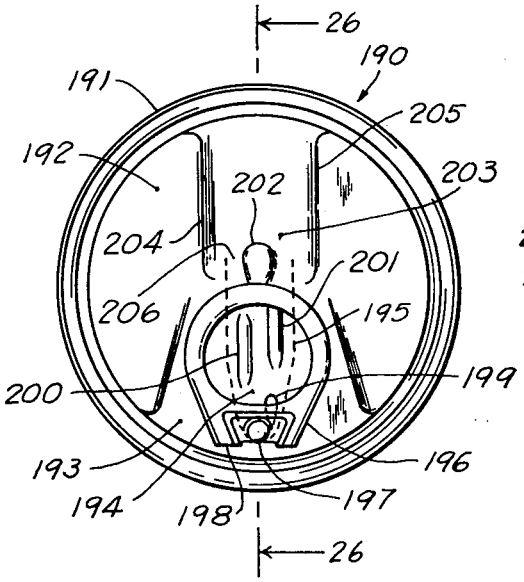

FIG. 26 is a partial cross-sectional elevation taken along line 26—26 of FIG. 25, and showing features of the design.

Figure 27:
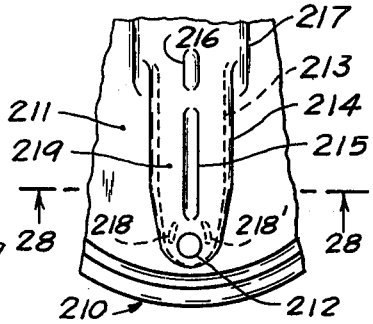

FIG. 27 is a partial plan view of a container top with tear segment having a double edge fold along the periphery of the segment.

Figure 28:
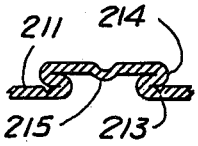

FIG. 28 is a partial cross-sectional elevation taken along line 28—28 of FIG. 27 showing the double edge fold.

Figure 29:
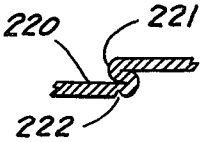

FIG. 29 is a cross-sectional view showing one side of the segment with a double edge fold, and with the score line groove on the underside of the top.

Figure 30:
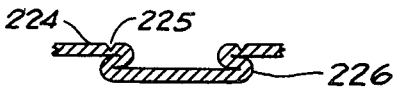

FIG. 30 is a partial cross-sectional view showing a double edge fold on the segment, and with the fold on the underside.

DESCRIPTION OF THE PREFERRED EMBODIMENTS

The invention will now be described in connection with, but not limited to, certain preferred embodiments.

The easy opening system for container tops whcih comprises a removable segment defined by a score line in the material of the top, and with a lifting tab attached to one end of the segment for the manual tearing out operation has been highly successful in the industry. It is low in cost, leakproof, resists internal pressure in the can, is fairly easy to open, and the wedge shaped opening is suitable for pouring out the contents of drinking directly from the can. An easy to operate low cost means for securing the opening segment to the can after opening has been difficult to achieve up to now.

Referring now to the drawings, I have shown the invention applied to circular tops that are part of a cylindrical can since this is the most common type in present use, but the invention applies equally well to any form or shape of container, and the opening can be on the top or any side. In current practise the top is made of aluminum, or of steel with an aluminum insert, as aluminum lends itself to easy scoring, forming, and drawing of integral rivets for lifting tab attachment. The invention also applies to tops made of other materials which may be found more suitable in the future, including plastics.

Figure 1:
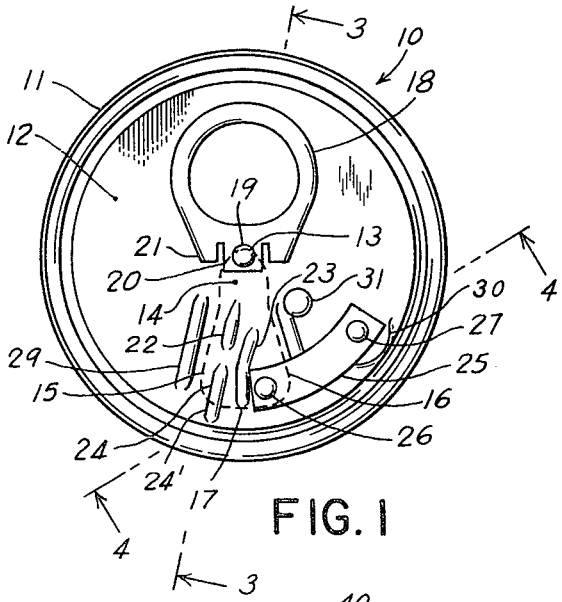
FIG. 1 is a plan view of the top of a container with an opening segment and swivel attachment embodying a preferred construction of the invention.

FIG. 1 shows a preferred form of the invention applied to a standard type of tear out segment opener. In FIG. 1 container 10 has top 12, preferably of aluminum, and attached to the side wall by rolled end rim 11. The openable segment 14 is defined by a peripheral score line which is shown dotted, and the sides of which are inner end 13, sides 15 and 16, and outer end 17 near the can rim. A ring pull tab is 18, and it is attached to the inner end of the segment close to score 13 by integral rivet 19, which is drawn from the metal of the top. The ring has an extension 20 which provides flexible attachment to the rivet, and has two legs 21 which press against the top when the ring is raised to open the can. The legs give added leverage to exert the 25 pound lift required to start rupture of the score with only a 3 pound pull on the ring.

Figure 2:
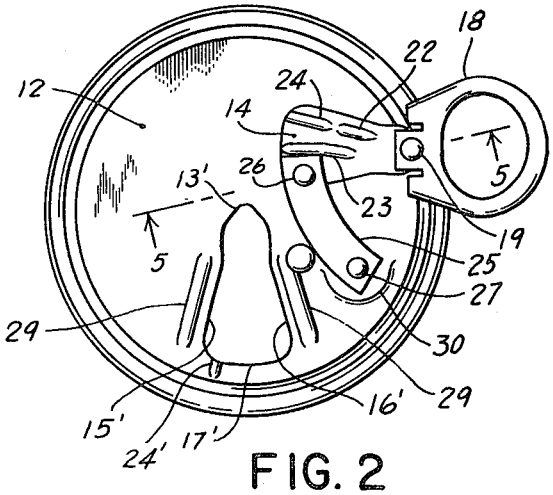
FIG. 2 is a plan view of the container top showing the attached segment of FIG. 1 after the opening operation.

In accordance with the invention the segment has several upstanding ribs which are press formed in the metal at 22, 23, and 24. The ribs are preferably off-set sideways, and with the ends overlapping in the lengthwise direction as shown. The ribs have three purposes. one is to provide protection to the user against cuts from the sharp torn edges after removal of the segment, another is to keep the end of the segment away from the tab flatter, eliminating the sharp curvature of torn segments up to now. This lets the segment lie flatter on the surface of the top in its swiveled out position, as shown in FIG. 2. The third reason is to reduce the pull required for opening, as described for FIG. 12.

In FIG. 1 the attachment means for the segment is swivel arm 25, which is shown attached to the segment 14 by integral rivet 26, and the outer end of the arm is pivotly attached to top 12 by integral rivet 27. Arm 25 may be of flat sheet material, and should be flexible so as not to interfere with raising of the segment to the vertical at the end of the tear out process, and at the same time it should be resilient and with a tendency to return immediately to its flat position. Its action should be similar to spring steel, which will flex readily, but not take a premanent set. An excellent material for the arm is polyamide, with its numerous types of nylon, several of which are excellent for this application due to great strength, flexibility, and return to the original shape. Also they can be held by a rivet without need of a washer. Another excellent material is polypropylene and it is lower in density and cost.

The swivel arm may be of many different sizes and shapes, but should be as compact as possible for lower cost and more rigid control of the segment after opening. Dimensions of sheet nylon or polypropylene that have proved satisfactory are 0.03 inch thick sheet, ¼ inch width, and 1 inch length. After the segment has been torn loose, it is swiveled around in a clockwise direction to the position shown in FIG. 2. There is enough friction in the rivet to hold the segment in this position, but a raised boss 31 is provided to lock it in the proper place.

The metal around rivet 27 is raised at 30, and the top of the riser tilts toward the direction of the segment in FIG. 2. This serves to overcome the crown of top 12 and press the segment down against the top, and also if a user rotates the segment in a counter clockwise direction, the tilt of 30 will cause the segment to clear the can rim 11 as it is swiveled around.

Figure 4:
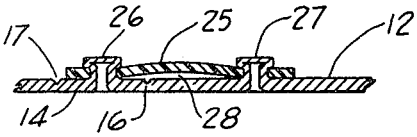
FIG. 4 is a partial cross-sectional elevation taken along line 4—4 of FIG. 1 showing the swivel arm in place.

If more slack is required in arm 25 during the segment opening process, the holes may be punched a little further apart than the space between the rivets. This is shown in FIG. 4 where the extra length causes the strip 25 to bulge at 28, this section being taken along line 4—4 in FIG. 1. Also in FIG. 1 are shown two raised ribs 29 to protect the lips of the user from the torn edges of the opening. This is usual practise, and is not shown in the other views for simplicity.

Figure 10:
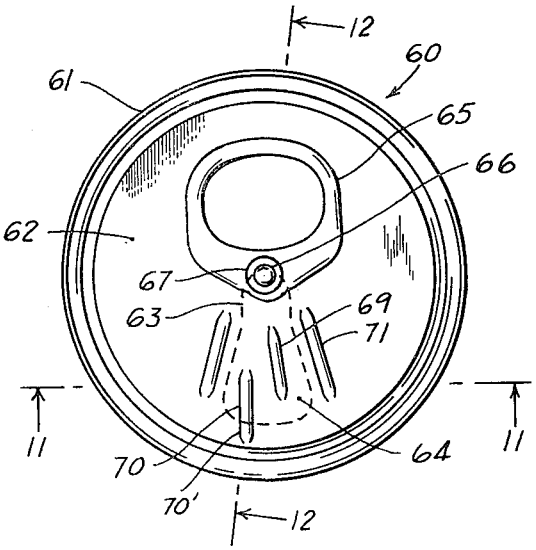
FIG. 10 is a plan view of a container top with tear out ribbed segment and the pull ring attached at the center of the top, but without the means for attachment after opening.
Figure 13:
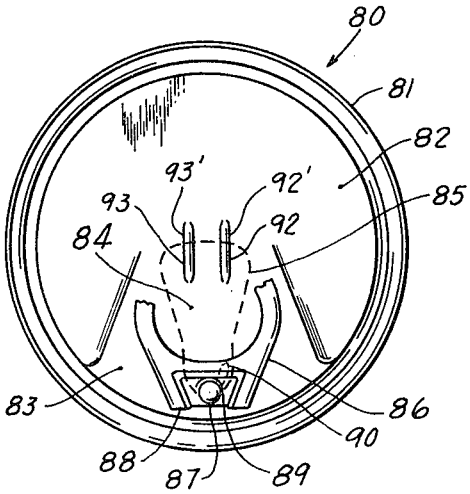
FIG. 13 is a plan view of a container top with openable segment and with the ring pull positioned near the rim, and also without swivel attachment but showing another features of the invention.

Whereas a single rib may be used to stiffen the segment, it is best to use several as shown in FIG. 1, where there are three ribs 22, 23 and 24. By using shorter ribs, which are offset, and with their ends overlapping in the lengthwise direction, it is possible to arrive experimentally at the best combination to give a flatter segment with easy tear out pull. The space between the ends of the ribs alows enough give so the ribs do not collapse or buckle. Rib 24 extends across the score line with end 24' on the far side. The rib is formed in the metal after the score is cut. With this rib, when the segment is torn out as far as the end score and the segment reaches the vertical position, the top of rib 24 butts against extension 24' and this serves to wedge the remainder of the end score line apart. It eliminates the need with present openers to rock the segment sideways to break the end score. This part of the invention applies to openers without the swivel attachment arm, and as shown in FIG. 10 and 13, as well as with arm.

Figure 3:
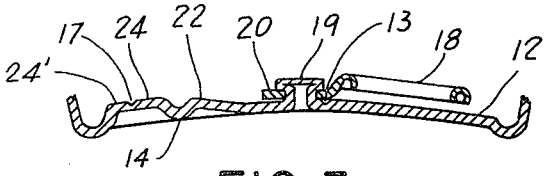
FIG. 3 is a partial cross-sectional elevation taken along line 3—3 of FIG. 1 showing the construction of the segment.
Figure 5:
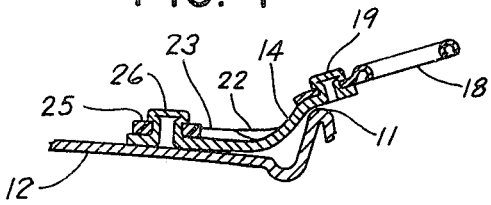
FIG. 5 is a partial cross-sectional elevation taken along line 5—5 of FIG. 2 showing the segment and ring in side storage position.

FIG. 3 is a cross-section taken along line 3—3 of FIG. 1 and shows rib 24 with its extended end 24', and with score line 17 following the top of the rib. The numbers on the other parts correspond with FIG. 1. FIG. 5 is a section along line 5—5 of FIG. 2 and shows the flat area of the segment pressed against top 12 by swivel arm 25 attached by rivet 26, and with the ring end fitting the curve of the can rim. Ring 18 can be pressed down further by hand if desired.

Figure 6:
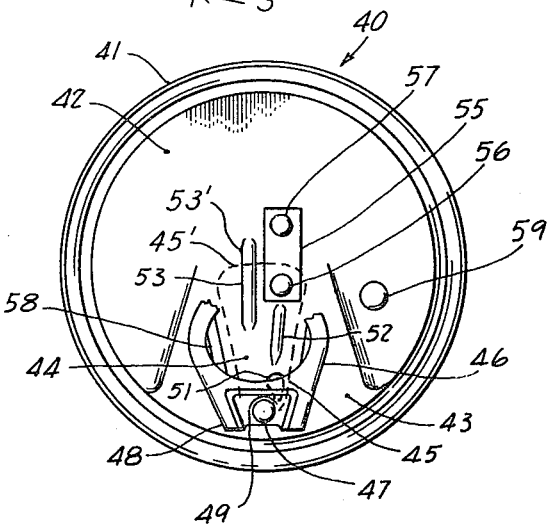
FIG. 6 is a plan view of a container top embodying another construction of the invention in which the lifting ring is positioned near the rim of the top.

The invention is shown applied to a segment having the tab attached near the can rim in FIG. 6. Can 40 has top 42 with rim 41 and score line 45 defining segment 44, which is partially stiffened by ribs 51, 52, and 53, the latter having extension 53' to assist the end score break. The surface of the top is raised at 43 to the level of the center so liquid will not blow out when the end score is first broken by raising ring tab 46. The ring has leverage ends 48 which push on the can top for greater force and in accordance with present art. An integral rivet 47 attaches the tab to the segment, and a cut is made at 49 to place the lifting force on the score side of the rivet. In accordance with the invention a downward projecting small rib 51 extends to just beyond the inner edge of the rivet, and serves to place a more gradual curvature on the part of the segment close to the rivet which has to make a 180 degree bend as the segment is torn out, and which otherwise tends to break off at this point.

A swivel arm 55 is provided for attachment of the segment to top 42 after opening. The attachment swivel arm 55 is secured to the segment by an integral rivet 56 and to the top of the container by an integral rivet 57. One advantage of this design with the lifting ring near the rim is that the swivel arm is very short and costs less. Another advantage is that when the end score is reached during the opening operation, and at which point the segment stands up vertically and the side score lines are sheared all the way down to the end score 45′, the arm 55 is placed in compression due to its upward curvature, and this in turn places strong tension forces on the segment which is on the outer arc of the 90° bend. This tension force serves to teear the metal in the end score apart, especially because the 55 arm is a little off-center. The rib 53 because of its extension 53′ beyond the score line also assists in the end score break.

The end of rib 52 can be tapered as shown at the end toward the tab in order to give a more gradual stiffening effect and to prevent a sharp bend at the end of the rib. This is also shown in FIG. 1 on rib 22. Raised ribs 58 are provided to protect the user from the sharp edges along the sides of the opening.

Figure 7:
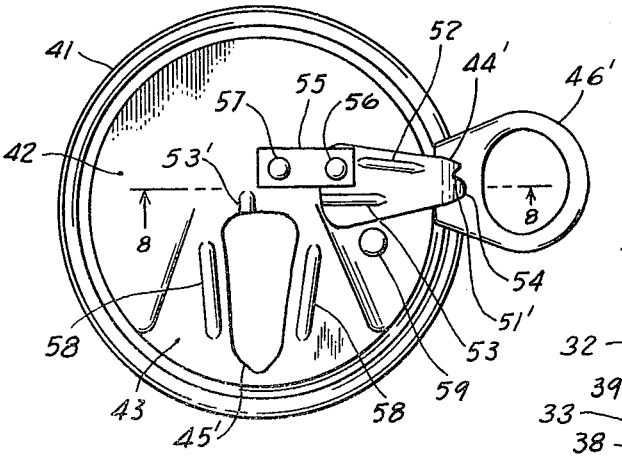
FIG. 7 is a plan view of the construction of FIG. 6 with the segment in its swiveled side position after opening.

FIG. 7 is a plan view of the container with attached opening segment of the FIG. 6 design, and showing the position of the opening segment and the pull ring off to one side after the segment has been torn out and the assembly swiveled over out of the way. The segment is held in this position by friction in the rivets, pressure against the top exerted by arm 55, and by projecting boss 59. If desired, in any of the swivel arm attachment arrangements, a small amount of semi-hard adhesive can be applied around the rivet where the arm is attached to the top to increase the friction. In the outer position the segment is 44′ and the lifting ring 46′. The end of the segment bends sharply at point 54 close to the rivet, and which is due to the reverses bend which is typical of the construction where the pull ring is located near the rim of the container. The provision of a small rib at this point, as shown at 51′ after opening, helps to prevent breaking off of the segment by increasing the radius of curvature. Another way to overcome this is to have the user rotate the ring 180° before opening, and so the ring projects out beyond the rim of the can, and when pulled up there is no reverse bend in the segment. It is too uncertain, however, to rely on the useer to do this consistently.

Figure 8:
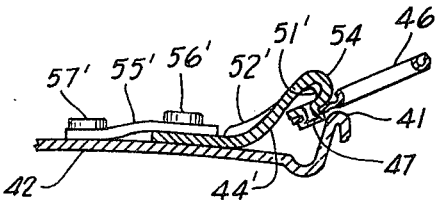
FIG. 8 is a partial cross-sectional elevation taken along line 8—8 of FIG. 7 showing the position of the segment and pull ring after opening and after the assembly has been swiveled to the side.

FIG. 8 is a partial cross-sectional elevation taken along line 8—8 in FIG. 7, and shows segment 44′ in the swiveled over position where it is held in plpace by the swivel arm 55′, and assisted by projecting boss 59 in can top 42. The drawing shows how the end of the segment has to bend 180 degrees near the rivet 47, and how the radius of curvature at 54 is made more gradual by small rib 51′ to decrease the tendency of the metal to break at this point.

Figure 9:
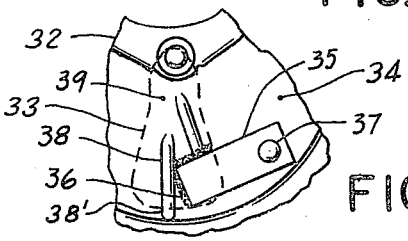
FIG. 9 is a fragmentary plan view of a container top showing an alternative means for attaching the swivel arm to the segment.

FIG. 9 is a fragmentary plan view of a segment 39 defined by score line 33 with lift ring 32 attached to the segment by a rivet. Rib 38 extends over the score line at 38′ to assist in breaking the end score. In this design the swivel arm 35 is attached to the segment by adhesive 36, and the other end is pivoted on rivet 37 attached to cap top 34.

Figure 11:
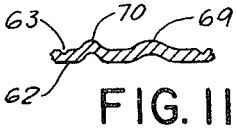
FIG. 11 is a partial cross-sectional elevation taken along line 11—11 of FIG. 10 showing the contour of the ribs.

Referring now to FIG. 10, this shows a container 60 which has a tear out segment such as is now in common use, but which does not have an attachment for holding the segment after removal to prevent it being discarded separately. The FIG. 10 design, however, includes features of the invention which make for more easy opening, and apply to openers with or without attachment features. The drawing shows a container 60 with top 62 attached to the side wall at rim 61, and with opening segment 64 outlined by score line 63. Ring tab 65 is attached to the inner end of the segment by rivet 66 and semi-spherical area 67 serves to provide added leverage for lifting the rivet and breaking the end score around it in accordance with the art. Ribs 71 protect the user against the sharp edges of the opening. In accordance with the invention two ribs 69 and 70 are formed in the material of the segment, and serve to decrease the pull required to tear the segment out along the side score lines, and when the end score at the rim is reached, the extension 70′ of rib 70 creates off-center forces that cause immediate rupture of the end score. FIG. 11 shows a cross-section taken along line 11—11 of FIG. 10, and indicates the contour of ribs 70 and 69 between score lines 63. Rib 70 is made sharper so the crown of the ridge is narrow and breaks easily in tension after the rest of the end score has parted. Stiffening rib 69 is more shallow so it can curve to a degree instead of buckling as the segment is torn out.

Figure 12:
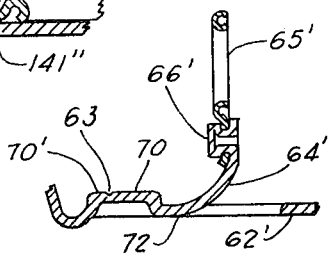
FIG. 12 is a partial cross-sectional elevation taken along line 12—12 of FIG. 10 in part, but actually showing the segment after it is partially lifted from the top by shearing along the score lines.

FIG. 12 is a cross-sectional view taken along line 12—12 of FIG. 10, but modified to show the position of the parts after the segment is torn about half way out. At this point ring tab 65′ is vertical, and is attached to segment 64′ by rivet 66′. and 64′ is partly free from top 62′. Because of the stiffening effect of the other rib 69 the segment has taken a more gradual curvature. This off-sets the line of the vertical pull on the ring and gives greater leverage for rupturing in shear the scores at point 72. The over-lapping space between the ends of the ribs provides enough give in the metal so the pull does not have to shear too great a length of score line at one time. The cross score at 63 is in the top of rib 70, the rib being press formed after the aluminum top has been scored.

FIG. 13 shows features of the invention applied to a tear out segment of a type now in use in which the tap is attached near the rim and there is no attachment after opening. Can 80 has rim 81, top 82, opening segment 84 defined by score line 85, ring tab 86 attached to the outer end of the segment by rivet 87 and with pressure legs 88 and cut 89 to throw the raising lift to the outside edge of the rivet. The segment has a small rib 90 to reduce the curvature at the rivet, and two ribs 92 and 93 at the inner end of the segment to assist in breaking off the score across the end by reason of their extensions 92′ and 93′ across the score line. The opening area may be raised as at 83.

Figure 14:
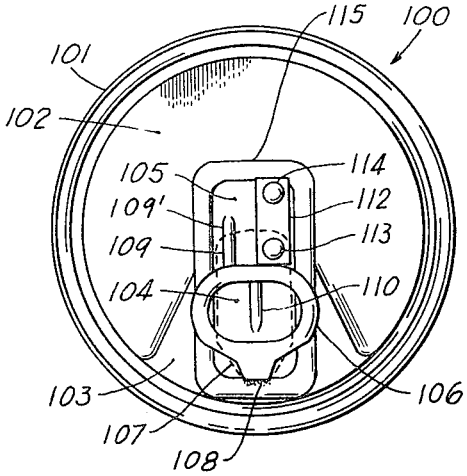
FIG. 14 is a plan view of a container top having an inserted frame containing the openable segment and with swivel attachment in accordance with the invention.

FIG. 14 shows the invention applied to a container top that has a segment carrying insert. Can 100 has rim 101 and top 102 which may be of plastic or steel. Frame 115 is adhesively secured in the top and a panel 105 of aluminum is adhesively held in the frame and contains segment 104 with score line 107 and ring pull 106 which is an extension of the aluminum panel so a rivet is not required. Foamed plastisol is used to seal where the connection 108 between the ring and the panel enters the frame. This type of opener is well known in the art, and features of the invention applying to it include ribs 110 and 109 with its extension 109′ serving to keep the inner end of the segment flat and to assist in breaking the end score, and swivel arm 112 attached to the segment by integral rivet 113 and to the top by rivet 114. If desired rivet 114 can be attached to the top exterenally of the frame. The swiveling out of the segment to a resting position on the top after opening is similar to t hat shown in FIG. 7.

Figure 16:
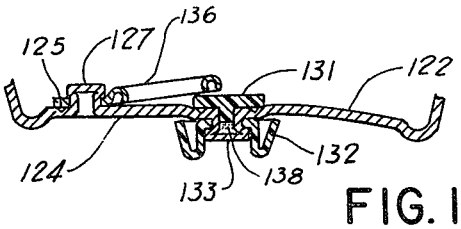
FIG. 16 is a partial cross-sectional elevation taken along line 16—16 of FIG. 15 showing how the segment is pivotly attached.
Figure 15:
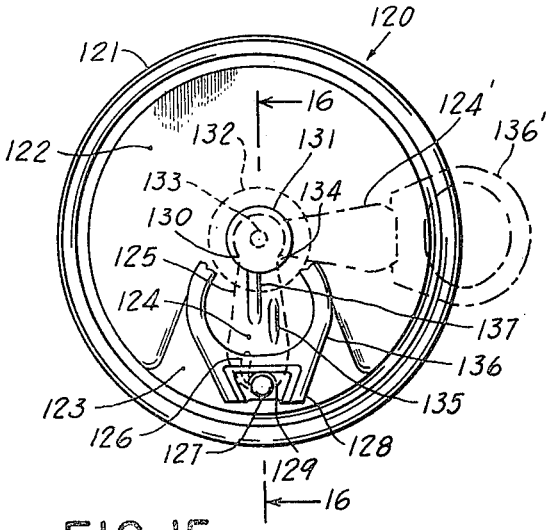
FIG. 15 is a plan view of a container top with an alternative construction of opening segment swiveling device which uses a signal pivot connection

A different method of attachment is shown in FIG. 15, but it works on the same principle of swiveling the segment to a side position after the segment has been torn free of the top along the score lines. Referring to FIG. 15 a can 120 with a rim 121 and top 122 has opening segment 124 outlined by score line 125, which is shown dotted. Pull ring 136 is attached to the end of the segment near the rim by rivet 127, and has pressure legs 128 and cut 129 to enhance opening leverage for initial score rupture. Rib 126 extends out past the inner edge of the rivet and projects downward. It serves to increase the radius of curvature of the metal which bends sharply close to the rivet on opening. Ribs 135 and 137 assist in the opening and maintain the flatness of the segment on opening. The score line is necked in at 130 and 134 to hold the pivoting means at the inner end of the opening. A disc 131, which may be of plastic, is adhesively held in the top opening of a downwardly projecting integral rivet at this point. The construction is shown in FIG. 16, which is a cross-sectional elevation along line 16—16 of FIG. 15. A soft plastic member 132, which may be made of polyvinyl chloride, is secured to the under side of the inner end of the segment by integral rivet 133 in FIG. 16. Also shown on this drawing are segment 124, scores 125 in top 122, lifting ring 136 attached by rivet 127, and the upper disc 131. This disc keeps the assembly from falling through the opening, and member 132 keeps it from moving out in the upward direction, at the same time due to its flexibility it does not prevent the user from tilting the segment up at 90° to rupture the end score at the center. Disc 131 is held by adhesive 138.

After opening the segment assembly is swiveled out to the side position shown by dot dash lines in FIG. 15. at 124′ and 136′.

Figure 18:
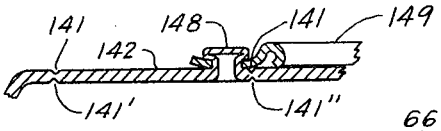
FIG. 18 is a partial cross-sectional elevation taken along line 18—18 of FIG. 17 and showing the supplementary short lengths of scoring on the under side of the top at each end of the segment.
Figure 17:
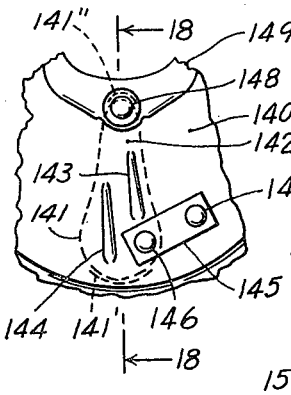
FIG. 17 is a fragmentary plan view showing a segment of different shape with an attached compact swivel arm in accordance with the invention, and with extra score lines on the under side.

Still another design of opening segment with attachment after opening is shown in plan view in FIG. 17 and in cross-section elevation in FIG. 18, and includes a fragmentary section of can top 140, segment 142, lifting ring 149 attached to the end of the segment by rivet 148. The peripheral score line around the segment in the top is shown dotted at 141 in FIG. 17. The segment has stiffening ribs 143 and 144, and swivel attachment arm 145 secured to the segment by integral rivet 146 and to the can top by integral rivet 147. A short length of supplementary score line is also provided in the under side across the outer end as shown at 141′ and also around the rivet at the inner end at 141″. This is also shown in FIG. 18. The under scores are in general registration with the upper scores but need not be in exact line to be fully effective, and may be grooves rather than sharp cuts. The scorres on the under side concentrate the stress and reduce the force required for rupture at the two strategic points, and as taught by my U.S. Pat. No. 3,411,661.

Figure 19:
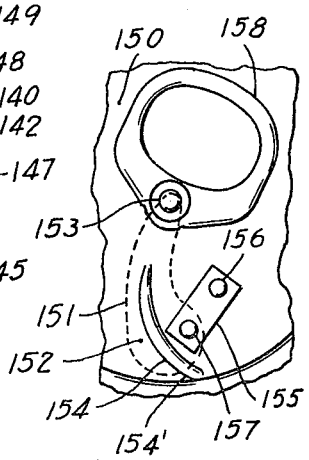
FIG. 19 is a fragmentary plan view showing a segment of different shape with an attached compact swivel arm in accordance with the invention.

Another alternative construction is shown in FIG. 19 in fragmentary plan view. Segment 152 in top 150 is defined by score line 151, rib 154 extends over and beyond the score line at 154′, for easier opening, swivel arm 155 is attached by rivets 156 and 157, and pull ring 158 is attached to the end of the segment by rivet 153. A single rib, which has its end extending over the score line and is positioned in the center of the end, is fully effective in breaking the end score with rounded ends because the width of unsheared metal is narrow with this type of end.

Figure 20:
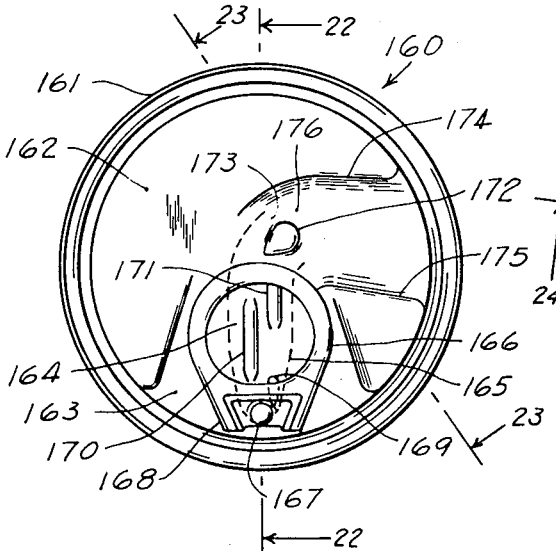
FIG. 20 is a plan view of a container top having a tear out segment with an unscored section at the inner end to provide attachment after opening, and with a curved shape so the segment is positioned to the side after opening, and with a cavity in the top into which the segment folds.

In keeping with the invention improvements have been made in the type of attached opening segment in which a small section of the score line is interrupted at the inner end to provide an attaching strip of top material. FIG. 20 shows container 160 with top 162, rim 161, score line 165 defining segment 164, and lifting tab 166 with pressure legs 168 and attached to the segment by rivet 167. There is sno score between the inner ends of the side score lines at point 173 and this section acts as attaching means after opening. The area of the top may be raised at 163 for the reasons explained above.

Figure 21:
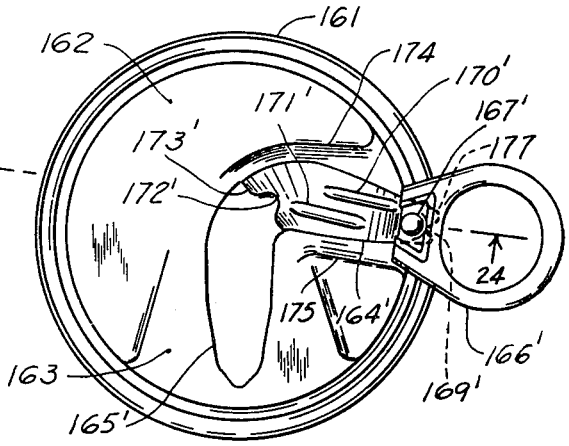
FIG. 21 is a plan view of the arrangement of FIG. 20 after the opening operation, and shows the side resting position of the segment and pull ring tab.

In keeping with the invention a number of improvements are shown in FIG. 20. A downward extending rib 169 starting at the side of the rivet serves to increase the curvature of the 180 degree bend at this point on opening, shown at 177 in FIG. 21, so the ring will not break off. Ribs 170 and 171 are provided in the segment to maintain its flatness for more compact storage after opening, and these ribs extend downwards so they give protection against cuts from the sharp sheared edges after the strip is turned back and is the other side up. A small tapered rib, projecting upward, is provided between the ends of the two side scores at 172. This is where the metal bends back at 180 degrees, and the rib forces a larger radius of curvature so the strip will not break off at this point if the user bends it back after emptying the container. Further the segment curves to the right toward the center, and the inner end is at an angle as shown. This causes the opened segment to lie in a storage position to the right side as shown in FIG. 21 where it will not interfere with the user's nose when he drinks from the can.

Figure 22:
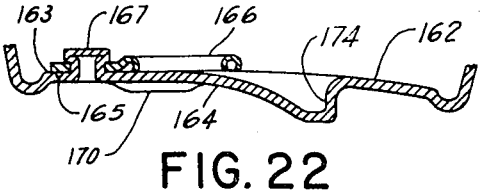
FIG. 22 is a partial cross-sectional elevation taken along line 22—22 of FIG. 20 showing construction of part of the opening segment with features of the invention.

A further improvement is the provision of a cavity formed in the top of the can into which the segment partially folds. The sides of the cavity are 174 and 175, and it is deepest at point 176, sloping from there up to the normal level at the rim. The segment is shown at 164′ in FIG. 21 in the opened position, and with the ring tab at 166′, the opening at 165′, and the other parts as marked. FIG. 22 is a cross-sectional elevation taken along line 22—22 of FIG. 20, and shows the construction of the lift tab and the level of area 163 where the segment is located.

Figure 23:
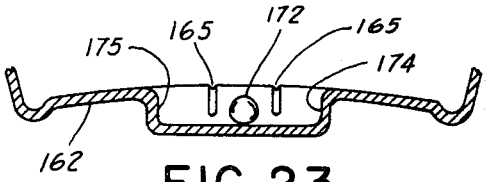
FIG. 23 is a partial cross-sectional elevation taken along line 23—23 of FIG. 20 showing details of the construction.
Figure 24:
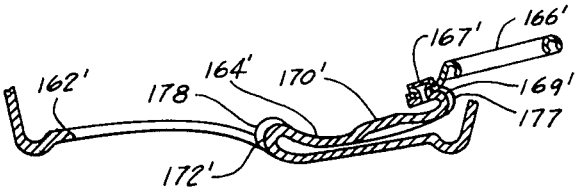
FIG. 24 is a partial cross-sectional elevation taken along line 24—24 of FIG. 21 showing the segment of the FIG. 20 design after opening.

FIG. 23 shows a section along line 23—23 FIG. 20 and indicates the form of depression walls 175 and 174, and the location of center rib 172 between the ends of the score lines 165. FIG. 24 is a cross-sectional elevation taken along line 24—24 in FIG. 21 and shows the segment in its storage position after opening and drawing over to the side. The part numbers correspond to the other figures. The partially curved segment 164′ lies in the cavity with the ring overhanging at 166′ The ribs 170′ and 171′ now stand upward for protection of the sharp edges. The radius of curvature at 173′ is more gradual because of rib 172′, as is also the curvature at the other end at 177 because of rib 169′. Since the inner end of the segment is on a curved down incline and curving into the bottom of the cavity, this gives a reverse bend after opening which causes it to lie lower in the cavity as shown in FIG. 24. A reverse bend of the segment at the inner end where the side scores terminate also helps to reduce the sharpness of bend 178 by giving the metal at this point an initial bend on a more gradual curve.

FIG. 25 shows an opening segment of this same general type, but opening straight across, which is satisfactory for containers whose contents are not to be consumed directly from the can. Can 190 has top 192 with rim 191, segment 194, score line 195, lifting ring 196 with pressure legs 198, and attached by rivet 197, ribs 199, 200, 201 and 202, and cavity in the top 203 with side walls 204 and 205. The rib 202 is at the center between the ends of the side score lines.

FIG. 26 is a cross-sectional elevation taken along line 26—26 of FIG. 25, and shows further details of the construction, which closely matches that previously described for the FIG. 20 arrangement. It will be noted that ribs 200 and 201 project downward and rib 202 upward. In general an upward rib if on a concave bend provides fifty percent more resistance to bending.

A very advantageous design is to provide a double edge fold along the periphery of the tear strip as shown in FIG. 27. The double edge fold is similar to the integral construction shown in my Pat. No. 3,411,661. It is integrally formed by pressing operations in the material of the top, and can be made in aluminum, steel or other ductile materials.

FIG. 27 shows a container 210 with top 211, and tear strip 219 defined by U-shaped score line 213. The edge fold extends around the periphery at 214. The fold may also extend along only parts of the periphery, if desired, and may be provided on the two long sides, and then fade out near the rivet 212. An optional reinforcing rib is shown at 215, and a small rib at 216, both for the reasons previously described. One or two small ribs 218 and 218′ may optionally be used to reduce the sharpness of the bend near the rivet on opening, but these are shown dotted, as the edge folds may serve the same purpose. The ring tab, not shown, is attached by rivet 212.

FIG. 28 is a sectional view taken along 28—28 of FIG. 27, and shows edge fold 214 in top 211, with score line groove 213 in the upper surface of the top. FIG. 29 is a similar view showing top 220 having fold 221, and with the score line groove 222 in the underside of the top. FIG. 30 is a similar cross-section but with edge fold 226 on the underside of top 224, and score line groove above at 225. The double edge fold may be either on the top side or the underside, and the score line groove may be on either the top or underside for either edge fold location, or there may be a score line groove on both sides, and these variations for all forms of the invention. One main advantage ofo the double edge folds is to give stiffness to the tear strip to reduce bending on opening.

The double edge fold is positioned near the score line, and its rounded edge may extend a little outward of the tearing point, or in line with it, or a little inward of it. A main purpose of the double edge fold is to prevent injury by presenting a rounded edge, and for best results it should extend outward a small amount.

Integral rivets are recommended, but separate rivets may be used provided they are sealed against leakage and protected on the inside against contamination of the contents. The scoring on the underside of the top, such as shown in FIG. 17 and FIG. 18, may also require protection, and this may be a coating of epoxy lacquer followed by a vinyl top coat, or similar protective coatings known in the art. A layer of soft plastisol can be used over the under scoring if desired for extra sealing protection.

The material for the swivel arm, such as shown in FIG. 1, may be cut from a strip of sheet stock in coil form, and the holes punched at the can top fabricating machine, and fed in continuously and assembled on the top automatically so there is almost no labor cost involved. Two materials that have been found to work well for the swivel arm are one of the polyamides and polypropylene. These materials have the desirable physical properties including flexibility, bendability at right angles, tendency to return to original flat shape after flexing, high tensile strength, good appearance, freedom from corrosion, and relatively low cost. There are numerous other materials that may be suitable, including acrylic film, acrylonitrile, butadiene, styrene, butyrate, high density polyethylene, polyallomers, ionomer, vinyl sheets, polystyrene copolymer, polyvinyl chloride, polyurethane, phenolics, polyester, melamines, polyvinyl flourides etc. These materials can also be used with fillers in some cases if desired.

It is also possible to use hard vulcanized fiber sheet, fish paper, aluminum, or steel. The preferred point of attachment of the swivel arm to the segment is shown in the various views, but attachment at other points is possible. The segment may be of relatively small size as shown in the drawings, or it may be large, and even comprise the whole top of the container as far as the application of some features of the invention is concerned. The term container top as used in the claims applies to the openable wall, even if the container is used or stored in some other position.

A number of the improvements of the invention whch are described in the specification in connection with the various types of opening segments having an attachment to the container after opening, have application also to a number of container opening systems now in general use, and which do not have an attachment after removal. These include stiffening ribs in the segment for easier opening, a small rib starting alongside the rivet holding the lift tab and extending into the main area of the segment in order to increase the radius of curvature near the rivet when the tab is raised and the metal near the rivet bent back, as with segments having a reversed ring position, a rib extending across the score line to assist in breaking off the score at the end of the pulling operation, and short lengths of a second score line on the under side in line with the upper score line, and most useful at either end of the segment.

In the claims the term "segment" means a removable area of any shape. The term "score line" refers to a weakening line formed by thinning the material. Rivets may be separately made but are preferably of the integral type drawn from the material of the top.

It will be apparent that while I have shown and described the invention in several preferred forms, changes may be made without departing from the scope of the invention, as sought to be defined in the following claims.

What I claim is:

1. In an easy open container having a top made of ductile metal and having easy opening means therein, and in which said easy opening means comprises, a generally U-shaped tear strip segment having an outer closed end and an inner attachment means end, and with said closed end positioned near the rim of said container top, and with the sides of said tear strip segment extending toward the inner region of said container top, said tear strip segment defined by a weakening score line extending around the periphery of said U-shaped tear strip segment except at said attachment means end, where said score line is interrupted to provide an unscored section of top material to serve as said attachment means between said tear strip segment and said container top after opening, a lift tab secured to said tear strip segment near said closed end, and for applying manual lifting force to tear said tear strip segment to open said container top, and an integral double edge fold band formed in the material of said tear strip segment and extending along the periphery of said tear strip segment, and said double edge fold band being an integral part of said tear strirp segment, and wherein the outermost rounded folded edge of said double edge fold band extends along and substantially parallel to and near said score line, and provides protection from the sharp torn edge of said tear strip segment after opening of said container top.

2. An easy open container as defined in claim 1 wherein said edge fold band extends at least along a substantial portion of each side of said U-shaped tear strip segment between said closed end and said attachment means end of said tear strip segment.

3. An easy open container as defined in claim 1 wherein the outermost rounded folded edge of said double edge fold band overhangs slightly outward of said sharp torn edge of said tear strip segment over a substantial length of said torn edge after opening of said container top.

4. An easy open container as defined in claim 1 wherein said U-shaped tear strip segment as defined by said weakening score line has an initial opening section which extends a substantial distance from said outer closed end which is positioned near said rim of said container, and extending toward the interior region of said container top, and at this point at least one of the two sides of said tear strip segment as defined by said score line, is curved to one side before terminating at said unscored attachment means end, and whereby after opening of said container top, and folding down of said opened tear strip segment to near said container top, said tear strip segment lies off to one side and at a substantial angle with the centerline of said initial opening section.

5. An easy open container as defined in claim 1 wherein there is a depression formed in said container top and extending beyond the openable area, and into which said tear strip segment can be at least partially folded after opening.

6. An easy open container as defined in claim 1 wherein said lift tab is secured to said tear strip segment by an integral rivet which is formed from the material of said container top.

7. An easy open container as defined in claim 1 wherein said integral double edge fold band is positioned on the upper side of said container top.

8. An easy open container as defined in claim 1 wherein said integral double edge fold band is positioned on the underside of said container top.

9. An easy open container as defined in claim 1 wherein said weakening score line has a score line groove in the upper side of said container top along at least part of said periphery of said U-shaped tear strip segment.

10. An easy open container as defined in claim 1 wherein said weakening score line has a score line groove in the underside of said container top along at least part of the periphery of said U-shaped tear strip segment.

11. An easy open container as defined in claim 1 wherein said container top is made of aluminum alloy.

12. An easy open container as defined in claim 1 wherein said container top is made of steel.

13. An easy open container as defined in claim 1 wherein there is an elongated formation in the material of said tear strip segment having a cross-section which is off-set relative to the plane of said segment, and which is positioned near said tab securement means, and extending alongside said securement means, and extending beyond in the general direction of the tear out of said tear out segment, and said elongated formation serving to provide added resistance against sharp bending in the material of said tear strip segment in the region near said tab securement means during opening of said container top.

14. An easy open container as defined in claim 1 wherein there is a narrow elongated off-set band formed in the metal of said container top, and extending lengthwise and across the bend line of said attachment means section between said tear strip segment and the adjacent part of said container top, and serving to increase the radius of curvature of the crosswise bend when said tear strip segment is folded down toward said container top after opening.

* * * * *